US007743442B2

(12) United States Patent
Maloney et al.

(10) Patent No.: US 7,743,442 B2
(45) Date of Patent: Jun. 29, 2010

(54) SYSTEM AND METHOD FOR ENHANCING THE SAFETY OF A SLEEPING ARRANGEMENT FOR A CHILD ON A BED

(75) Inventors: Jeremy Maloney, Belle Isle, FL (US); Randy Ray Vaughn, Orlando, FL (US)

(73) Assignee: The Incredibeds LLC, Belle Isle, FL (US)

( * ) Notice: Subject to any disclaimer, the term of this patent is extended or adjusted under 35 U.S.C. 154(b) by 0 days.

(21) Appl. No.: 12/392,362

(22) Filed: Feb. 25, 2009

(65) Prior Publication Data

US 2009/0211024 A1 Aug. 27, 2009

Related U.S. Application Data

(60) Provisional application No. 61/031,044, filed on Feb. 25, 2008.

(51) Int. Cl.
*A47C 21/08* (2006.01)
*A63H 3/00* (2006.01)

(52) U.S. Cl. ..... 5/655; 5/743; 5/739; 5/907; 5/424; 446/72

(58) Field of Classification Search ..... 5/424, 5/425, 427, 655, 907, 946, 732, 739, 678, 5/680

See application file for complete search history.

(56) References Cited

U.S. PATENT DOCUMENTS

D216,666 S 3/1970 Thomas
3,619,824 A 11/1971 Doyle
D228,991 S 11/1973 Hinton
D236,776 S 9/1975 Phillips et al.
3,950,796 A 4/1976 Hollingsworth
4,106,138 A * 8/1978 Murphy ..... 5/181
D249,403 S 9/1978 Lamb
4,190,916 A * 3/1980 McMullan ..... 5/671
D286,232 S 10/1986 Fisher
4,637,082 A 1/1987 Moore et al.
4,800,600 A 1/1989 Baum
D300,681 S 4/1989 DeMars
4,873,734 A * 10/1989 Pollard ..... 5/425
D313,322 S 1/1991 Ventulett
4,998,310 A * 3/1991 Olson ..... 5/710

(Continued)

*Primary Examiner*—Michael Trettel
(74) *Attorney, Agent, or Firm*—Robert L. Wolter, Esq.; Cian G. O'Brien, Esq.; Beusse Wolter Sanks Mora & Maire, P.A.

(57) ABSTRACT

A system is provided for enhancing the safety of a sleeping arrangement for a child on a bed. The bed includes a mattress and a boxspring. The system includes a frame to enclose a perimeter of the mattress and the boxspring. The frame includes a plurality of sections, which are removably attached at respective junctures with hook and loop fasteners. An outer surface of the frame is formed from a plush material. The plurality of sections includes a pair of side sections which extend along a respective pair of opposing side surfaces of the mattress and the boxspring. The pair of side sections includes a respective vertical bumper configured to extend from a top portion of the side sections by a predetermined height, to prevent the child on the bed from passing outside the side surfaces of the mattress and falling from the mattress.

23 Claims, 7 Drawing Sheets

U.S. PATENT DOCUMENTS

| | | | | | |
|---|---|---|---|---|---|
| D322,723 | S | | 12/1991 | Barry et al. | |
| 5,103,514 | A | * | 4/1992 | Leach | 5/417 |
| 5,184,360 | A | | 2/1993 | Gonzalez | |
| D335,973 | S | | 6/1993 | Moody et al. | |
| 5,233,710 | A | | 8/1993 | Bernard | |
| D356,900 | S | | 4/1995 | Chesmore | |
| 5,455,973 | A | * | 10/1995 | Brumfield et al. | 5/424 |
| D370,045 | S | | 5/1996 | Derbecker | |
| 5,515,559 | A | | 5/1996 | Benson | |
| D372,599 | S | | 8/1996 | Cacciola et al. | |
| 5,626,388 | A | | 5/1997 | Haltner | |
| 5,642,546 | A | * | 7/1997 | Shoenhair | 5/680 |
| D412,071 | S | | 7/1999 | Brandis, Jr. | |
| 6,026,525 | A | * | 2/2000 | Davis | 5/99.1 |
| 6,199,230 | B1 | * | 3/2001 | Parikh | 5/420 |
| 6,256,965 | B1 | | 7/2001 | Sheridan | |
| D471,375 | S | | 3/2003 | Nichols, III et al. | |
| 6,578,214 | B2 | | 6/2003 | Peftoulidis | |
| D486,000 | S | | 2/2004 | Bourget | |
| 6,799,337 | B1 | | 10/2004 | Raphael-Davis et al. | |
| 6,848,130 | B1 | * | 2/2005 | Wilson | 5/425 |
| D507,708 | S | | 7/2005 | Jannetides | |
| 6,983,494 | B1 | | 1/2006 | Jannetides | |
| 7,107,635 | B2 | * | 9/2006 | Henry et al. | 5/424 |
| 7,546,648 | B2 | * | 6/2009 | Steffes | 5/400 |
| 2004/0130449 | A1 | | 7/2004 | Hung | |
| 2006/0010605 | A1 | | 1/2006 | Kamrin-Balfour | |
| 2007/0079444 | A1 | * | 4/2007 | Ward | 5/655 |

* cited by examiner

SYSTEM AND METHOD FOR ENHANCING THE SAFETY OF A SLEEPING ARRANGEMENT FOR A CHILD ON A BED

CROSS-REFERENCE TO RELATED APPLICATIONS

This application claims benefit of U.S. Provisional Application No. 61/031,044 filed Feb. 25, 2008, and incorporated herein by reference in its entirety.

BACKGROUND OF THE INVENTION

This invention relates to a sleeping arrangement for a child on a bed, and more particularly, to a system and method for enhancing the safety of a sleeping arrangement for a child on a bed.

A sleeping arrangement of a child, such as a child sleeping on a bed frame, mattress and a boxspring, for example, may present safety concerns. For example, the sleeping height of the child in such a sleeping arrangement may be 18-28 inches (45.72-71.12 centimeters), based on the typical 6-10 inch (15.24-25.4 centimeter) height of the standard frame, and the typical 6-9 inch (15.24-22.86 centimeter) height for each respective mattress and boxspring. Thus, in the unfortunate scenario that a child falls from such a sleeping arrangement, a fall of 18-28 inches (45.72-71.12 centimeters) would be endured. Several conventional systems have been developed, such as those discussed below, to reduce these safety concerns.

U.S. Pat. No. 4,800,600 to Baum discloses a fancifully-shaped crib bumper having stuffed legs serving in the traditional role of a crib bumper, as well as stuffed arms that provide added protection higher up on the side of a crib. The tubular arms and legs of the novel crib bumper are stuffed by using rolled fiberfill batting, which is placed in an insertion device that may be either preformed in a tubular shape or may comprise a flexible sheet material that is rolled around the rolled fiberfill batting. The use of the insertion device permits the rolled fiberfill batting to be inserted into a crib bumper leg or arm in a simple, easy manner, and is then removed, leaving the fiberfill batting in place. The fiberfill batting is then securely attached to the outer casing of the crib bumper by stitching.

U.S. Pat. No. 6,256,965 to Sheridan discloses a method for the design and fabrication to reproduce a preselected subject matter such as a wild animal in a material comfort object incorporating a cavity that may be enhanced into an enclave by incorporating preselected portions of the subject matter such as a head or legs to add a surround to the cavity, giving preference to reproducing areas of the subject matter with plush material which resembles the color and texture of the subject matter while maintaining easy access to the cavity thereby presenting an exposed surface or comfort panel that is soft, warm and inviting to the user of the object. A sound reproduction device may be added to the object to provide preselected sounds; a child safe pocket may be formed in the object to hold the sound reproduction device.

U.S. Pat. No. 6,578,214 to Peftoulidis discloses various sport-shaped bed designs consisting of a frame, mattress, motion sensors, a rechargeable battery cell and a dimmer night light. The designs have shapes such as a football, baseball, soccer, basketball, and other sport shapes. The bed also comprises storage drawers located in various positions according to the design. Each bed contains battery-operated motion sensors which trigger a night dimmer light. When the sensor indicates a child has laid down in the bed, the dimmer responds to the signal and the light goes on. Within a short period of time, the light slowly dims until it is fully out. If the child should sit up, the sensor will react and the light will go on. The mattress fits down inside a recess in the frame and the headboard.

Although Baum discloses a crib bumper, it does not involve a bumper which is designed to be utilized within a bed frame used with a mattress and a boxspring, for example. Additionally, since the crib bumper is installed on the frame of the crib, it does not reduce the height of the frame of the crib to the ground, thereby permitting this additional height to contribute in an unlikely fall from the bed. Sheridan discloses a cavity which is sized to receive the user, and thus the cavity is not sized to receive a mattress or boxspring. Additionally, Sheridan discloses that the frame is integrated/one-piece, and thus would not be separable into manageable, washable components, for example. Although Peftoulidis discloses a frame configured to receive a mattress, the frame includes storage drawers which raise the height of the mattress (i.e., the child), relative to the ground, and thus permit this increased height to elevate the safety concern. Additionally, as with Sheridan, the frame is a one-piece frame, and would not be separable into manageable, washable components, for example.

Thus, it would be advantageous to provide a system which provides a bed frame which reduces the height at which the child sleeps, relative to the ground, while also reducing the likelihood that a child will fall from the bed, and conveniently providing the frame in manageable, washable components, for example.

BRIEF DESCRIPTION OF THE INVENTION

One embodiment of the present invention provides a system for enhancing the safety of a sleeping arrangement for a child on a bed. The bed includes a mattress and a boxspring. The system includes a frame to enclose a perimeter of the mattress and the boxspring. The frame includes a plurality of sections, which are removably attached at respective junctures with hook and loop fasteners. An outer surface of the frame is formed from a plush material. The plurality of sections includes a pair of side sections which extend along a respective pair of opposing side surfaces of the mattress and the boxspring. The pair of side sections includes a respective vertical bumper configured to extend from a top portion of the side sections by a predetermined height, to prevent the child on the bed from passing outside the side surfaces of the mattress and falling from the mattress.

Another embodiment of the present invention provides a system for enhancing the safety of a sleeping arrangement for a child on a bed, which includes a mattress. The system includes a frame configured to enclose a perimeter of the mattress. The frame includes a plurality of sections, which are removably attached to one another. The plurality of sections includes a pair of side sections which extend along a respective pair of opposing side surfaces of the mattress. The pair of side sections includes a respective vertical bumper to extend from a top portion of the side sections by a predetermined height, to prevent the child on the bed from falling from the mattress.

Another embodiment of the present invention provides a method for enhancing the safety of a sleeping arrangement for a child on a bed. The bed includes a mattress and a boxspring. The method includes enclosing a perimeter of the mattress and the boxspring with a frame. The frame includes a plurality of sections, which have an outer surface formed from a plush material. The enclosing step includes extending a pair of side sections of the plurality of sections along a respective pair of opposing side surfaces of the mattress and the boxspring, and removably attaching the plurality of sections at respective junctures with hook and loop fasteners. The method further includes extending a respective vertical bumper from a top portion of the side sections by a predetermined height, to prevent the child on the bed from passing outside the side surfaces of the mattress and falling from the mattress.

BRIEF DESCRIPTION OF THE DRAWINGS

A more particular description of the invention briefly described above will be rendered by reference to specific embodiments thereof that are illustrated in the appended drawings. Understanding that these drawings depict only typical embodiments of the invention and are not therefore to be considered to be limiting of its scope, exemplary embodiments of the invention will be described and explained with additional specificity and detail through the use of the accompanying drawings in which.

DETAILED DESCRIPTION OF THE INVENTION

Figure 1:
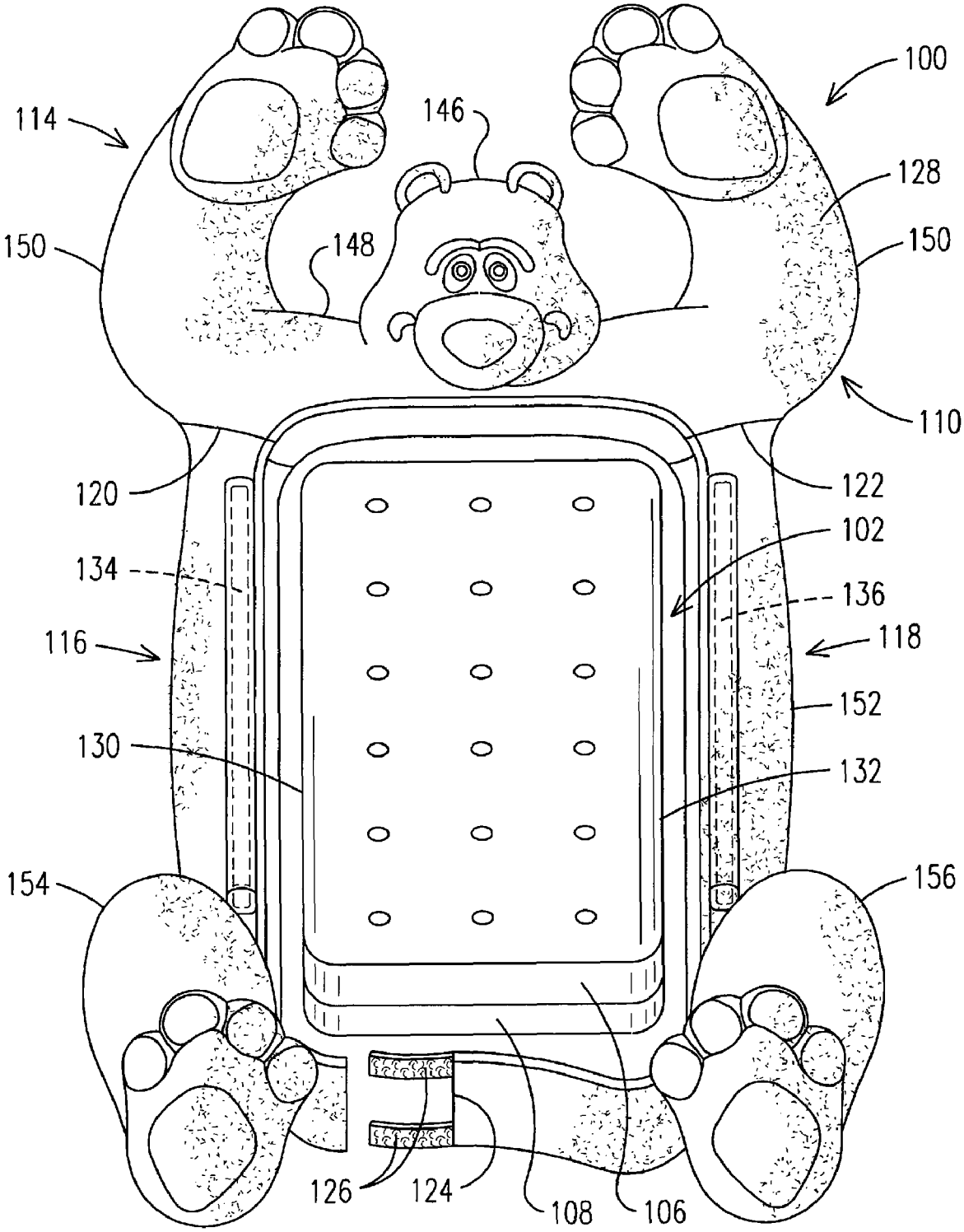
FIG. 1 depicts an top exploded view of an exemplary embodiment of a system for enhancing the safety of a sleeping arrangement for a child on a bed in accordance with the present invention.

Reference will now be made in detail to the embodiments consistent with the invention, examples of which are illustrated in the accompanying drawings. Wherever possible, the same reference numerals used throughout the drawings refer to the same or like parts.

FIG. 1 illustrates an exemplary embodiment of a system 100 to enhance the safety of a sleeping arrangement for a child on a bed 102. The bed 102 includes a mattress 106 and a boxspring 108 (FIG. 3), however the bed may just include the mattress, without the boxspring. The mattress and boxspring may be any one of a single, twin, double, queen or king size mattress/boxspring, and the frame 110 would be correspondingly sized to accommodate the size of the mattress/boxspring. Additionally, the frame 110 may be sized to accommodate a crib mattress/boxspring, and thus the bed 102 and frame 110 may be utilized as a "transition bed" for toddlers and children as they transition from a crib to a full-sized bed. Additionally, as discussed below, in an exemplary embodiment of the present invention, the frame 110 rests on a floor 176 of a room (FIG. 4), and thus the bed 102 is inherently positioned low to the ground, to enhance safety, as a toddler/child transitions from a crib to a full-sized bed.

As illustrated in the exemplary embodiment of FIG. 1, the system 100 includes a frame 110 which encloses a perimeter of the mattress 106 and the boxspring 108. As illustrated in FIG. 1, the frame 110 takes the form of an animate object, such as a bear, and the frame 110 has an outer surface 128 which is formed from a plush material, such as a plush material which conforms to ASTM (American Society for Testing and Materials) standards, for example. However, the frame 110 may take the form of an inanimate object, such as a toy train, for example. Thus, although the embodiments of the present invention discussed below refer to an exemplary embodiment of a frame taking the form of an animate object, such as a bear, the frame may take the form of any animate or inanimate object, provided that it adequately enhances the safety of the sleeping arrangement, as prescribed below. In an exemplary embodiment, the plush material which forms the outer surface of the frame 110 is washable, such that the exterior of the frame may be easily removed and/or cleaned, such as in a standard washing machine, for example.

The frame 110 includes a plurality of sections 114,116, 118, which are removably attached to one another at respective junctures 120,122,124 with hook and loop fasteners 126, such as VELCRO® fasteners, a registered trademark, or a zipper, for example. The plurality of sections 114,116,118 include: a top section 114 which forms a head 146, shoulders 148, and/or arms 150 (FIGS. 2-3) of the animate object; and a pair of side sections 116,118 which form a side 152 and legs 154,156 of the animate object. The top section 114 and side sections 116,118 are removably attached with the hook and loop fasteners 126 adjacent to a respective arm-pit juncture 120,122 of the animate object. Additionally, the respective side sections 116,118 are removably attached with the hook and loop fasteners 126 adjacent to a heel juncture 124 of the legs 154,156 of the animate object. Although FIG. 1 illustrates the junctures 120,122,124 being positioned adjacent to the armpit and heel regions of the animate object, the junctures may be positioned at any region of the animate object, and more or less than three junctures and sections may be employed, depending on the particular design. In an additional exemplary embodiment, the arms 150 may be removably attached to the top section 114, with hook and loop fasteners, such as VELCRO® fasteners, a registered trademark, or a zipper, for example. Although the illustrated embodiments of the present invention in FIGS. 1-10 depict the frame 110 as a plurality of sections 114,116,118 which are removably attached, the frame may be formed from a one-piece section, and which is formed from the same plush material, for example.

In an exemplary embodiment of the present invention, the pair of side sections 116,118 extend along a respective pair of opposing side surfaces 130,132 (See FIG. 1, 3) of the mattress 106 and the boxspring 108. Since FIG. 1 is an exploded view, it illustrates side sections 116,118 being separated from the opposing surfaces 130,132, to illustrate these components. However, as discussed below, during operation of the frame 110, the side sections 116,118 are securably engaged to the opposing side surfaces 130,132. The pair of side sections 116,118 include a respective vertical bumper 134,136 to extend from a top portion 138 (FIG. 6) of the side sections 116,118 by a predetermined height. The predetermined height of the vertical bumper 134,136 is established to prevent the child on the bed 102 from passing outside the side surfaces 130,132 of the mattress 106 and falling from the mattress 106. As discussed above, the bed 102 and frame 110 may be utilized as a "transition bed" for a child/toddler as they transition from a crib bed to a full-sized bed. The bed 102 and frame 110 may be utilized during this transition period, as the vertical bumpers 134,136 enhance the safety conditions of the child sleeping in the bed 102. Additionally, even after the child matures to being capable of sleeping in a full-sized bed, the child can remain in the bed 102 and frame 110, as the vertical bumpers 134,136 may be removed, as discussed below.

Figures 2, 3:
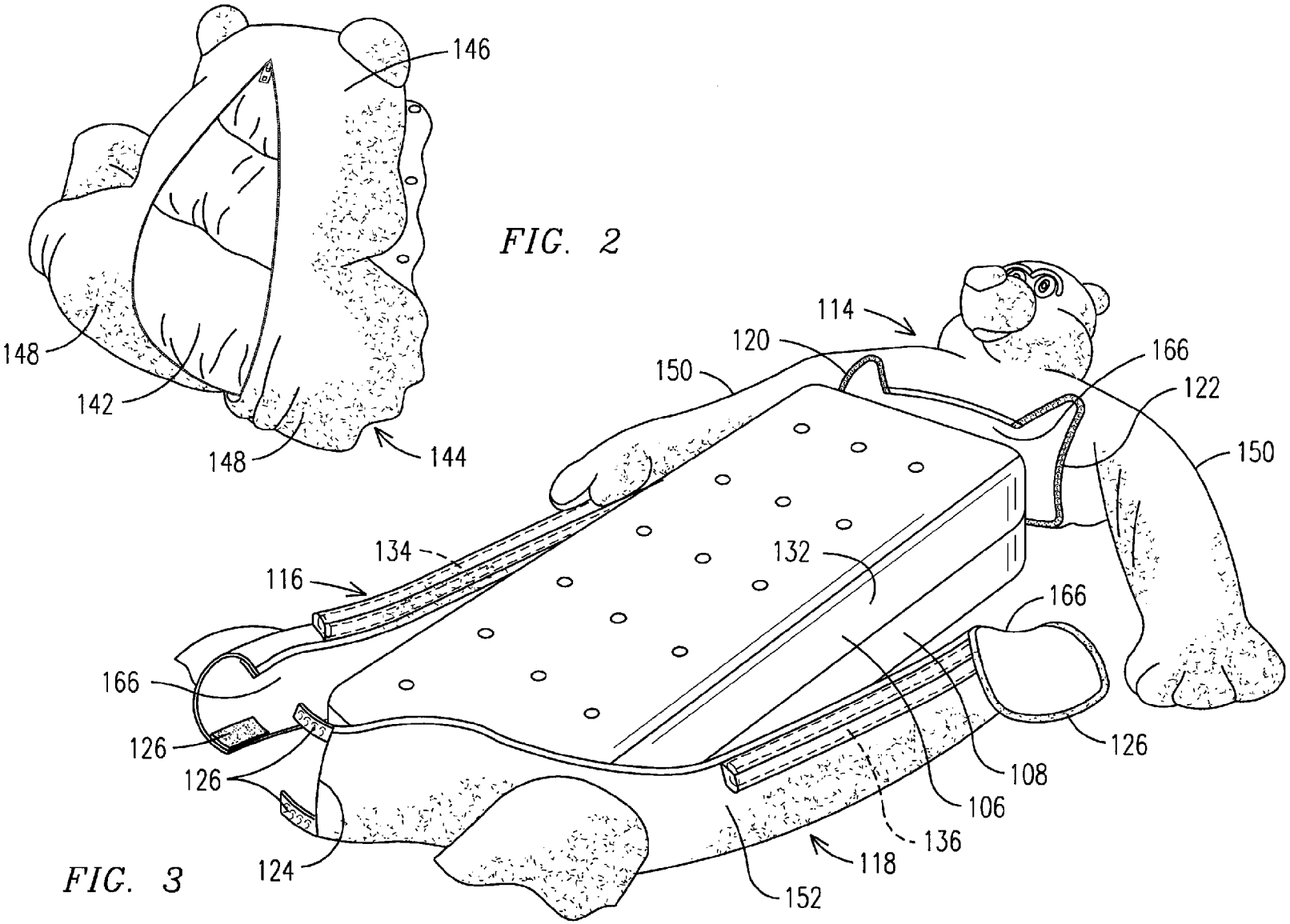
FIG. 2 depicts a partial rear perspective view of an interior of a frame within the system illustrated in FIG. 1.
FIG. 3 depicts a side exploded view of a plurality of sections and a mattress and boxspring of the system illustrated in FIG. 1.

As illustrated in the exemplary embodiment of FIG. 2, which depicts a rear view of the head 146 of the top section 114 of the frame 110, and the outer surface of the top section 114 having been opened to reveal that an interior of the frame 110 is filled with a foam and/or cushion material 142, such as polyfill, for example. Such foam and/or cushion material 142 which fills the frame 110 is easily removable and washable/replaceable, so to simplify the maintenance of the frame 110. Although FIG. 2 illustrates the top section 114, and more specifically, the head 146 of the animate object being opened to reveal the interior cushion material, the interior of each section of the frame 110 may include a similar access point to the interior, to permit the interior cushion material to be removed and/or washed.

Figure 9:
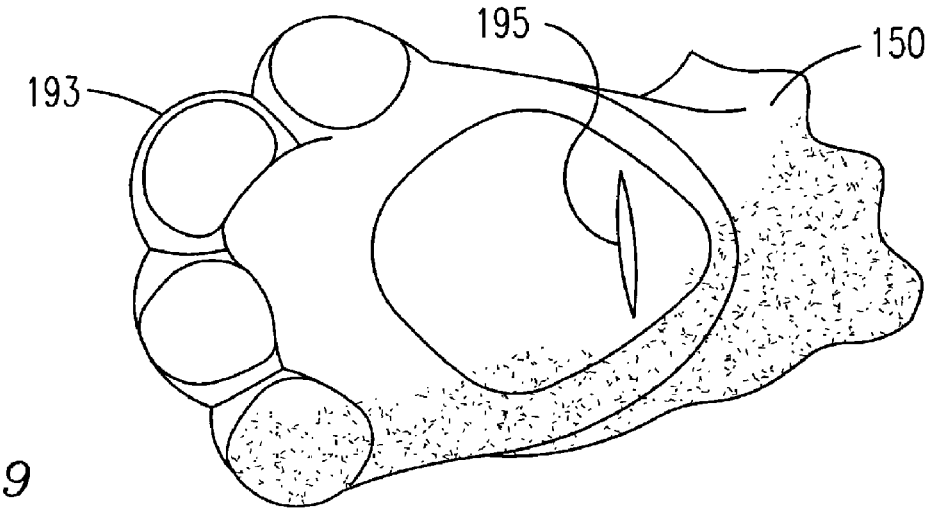
FIG. 9 depicts a partial perspective view of a hand portion of the frame illustrated in FIG. 1, with a slot formed within the hand portion to receive a hand of a child positioned on the bed.

As illustrated in the exemplary embodiment of FIG. 9, the arm 150 of the animate object may end at a paw/hand 193, which includes a slot 195 configured to receive a hand of the child who sleeps on the bed 102. Upon receiving the hand of the child in the slot 195, the arms 150 of the animate object may be maneuvered, so to embrace the child, as the child crosses their arms, for example. In an exemplary embodiment, an institution which houses children, such as a pediatric hospital or a child care center, may utilize the frame 110 for therapeutic purposes and/or to soothe the child and/or motivating the child to sleep, for example.

Figure 4:
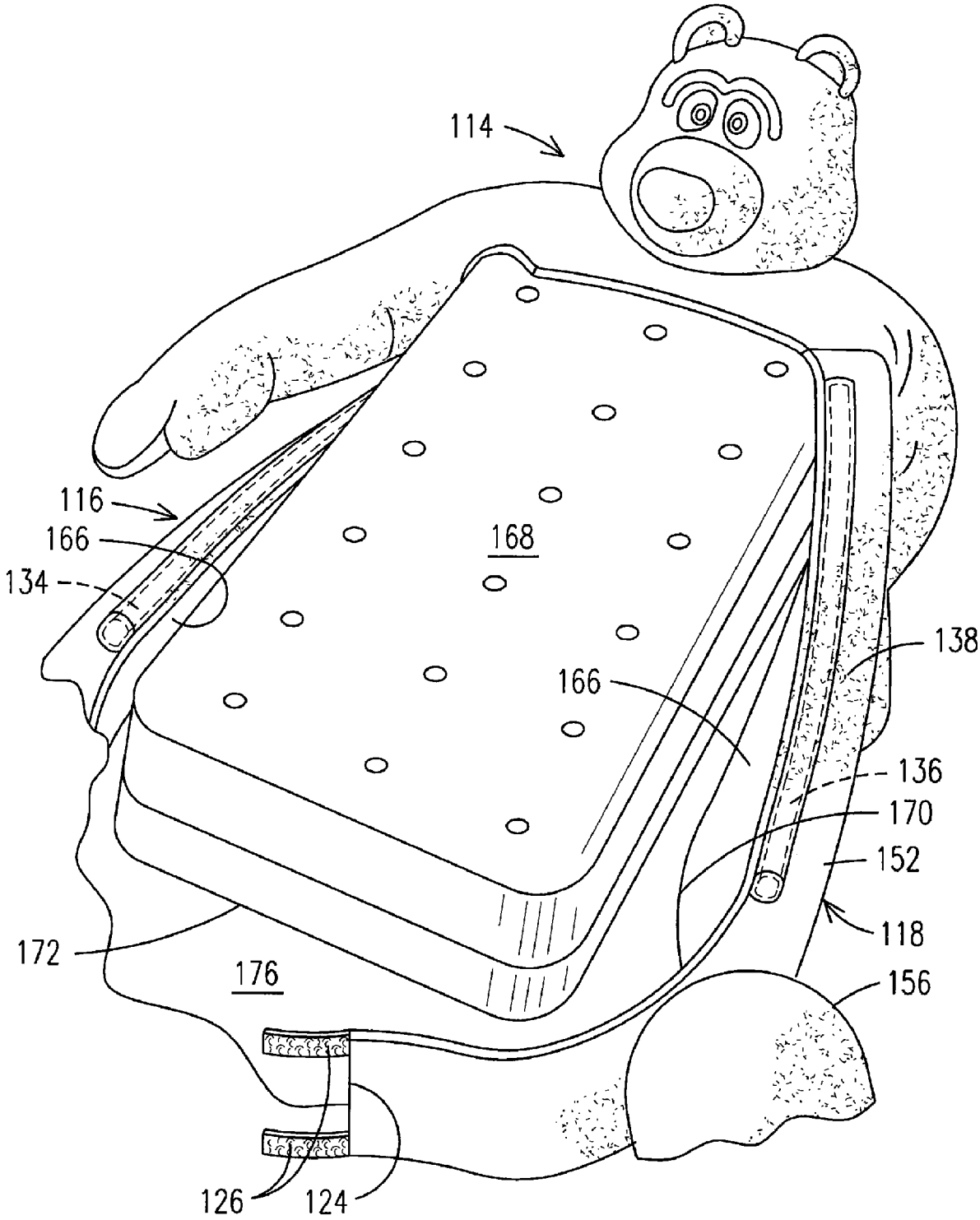
FIG. 4 depicts a front exploded view of the plurality of sections and a mattress and boxspring of the system illustrated in FIG. 1.
Figure 6:
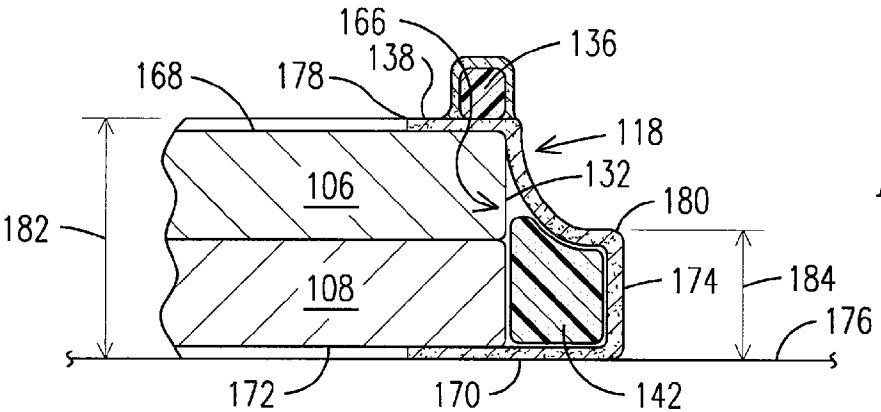
FIG. 6 depicts a side cross-sectional view of the plurality of sections and mattress and boxspring of the system illustrated in FIG. 4.
Figure 5:
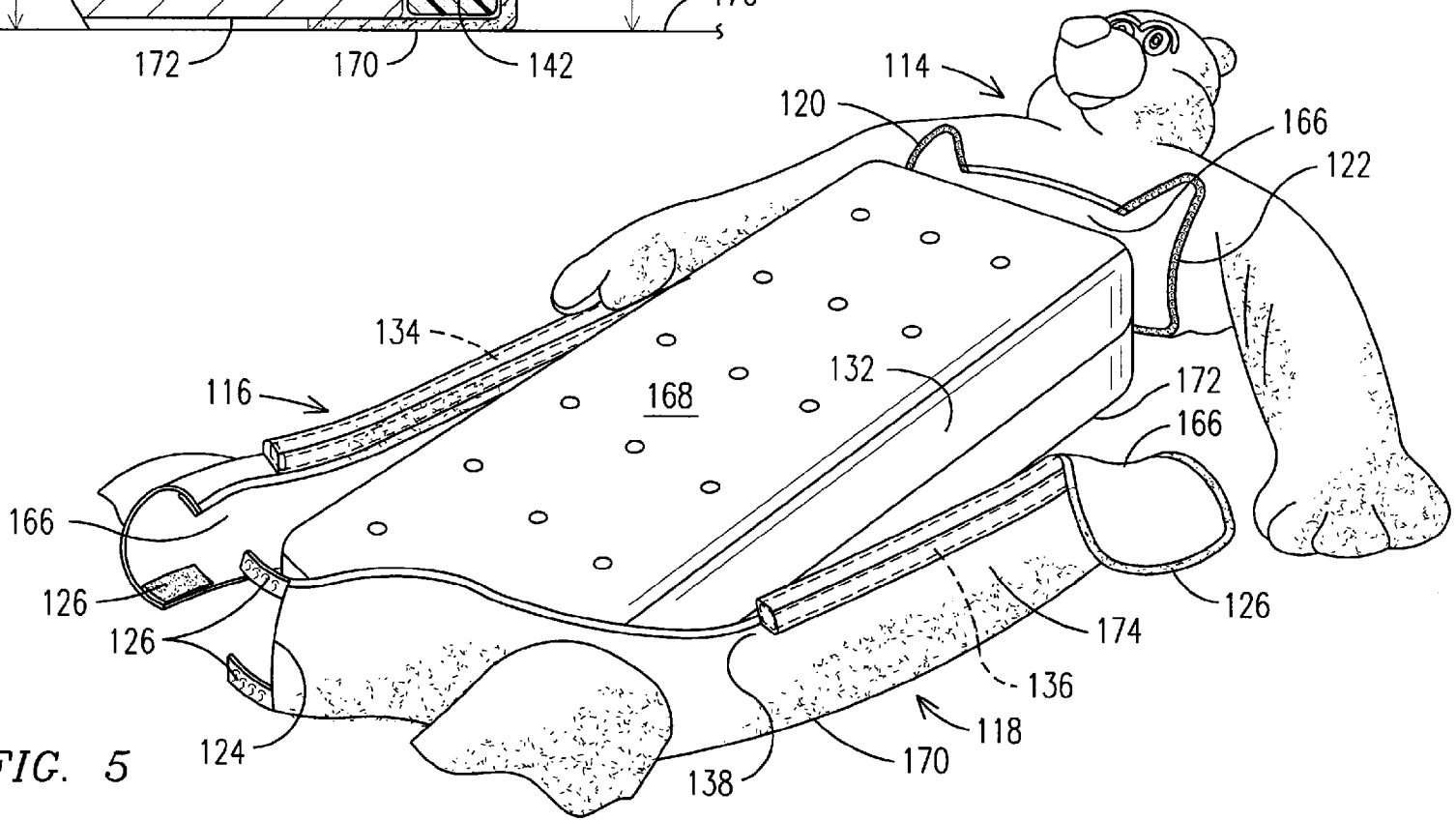
FIG. 5 depicts a front exploded view of the plurality of sections and a mattress and boxspring of the system illustrated in FIG. 1.

As illustrated in the exemplary embodiment of FIG. 4, the plurality of sections 114,116,118 are respectively dimensioned such that a portion of the mattress 106 and boxspring 108 are received within a cavity 166 of the respective sections 114,116,118. Although FIG. 3 illustrates the mattress 106 and boxspring 108 being received within the cavity 166 of the side section 118, the mattress 106 and boxspring 108 are received within an equivalent cavity 166 of the sections 114,116. As illustrated in FIGS. 5-6, the cavity 166 is defined by the top portion 138 of the section 118 extending along a portion of a top surface 168 of the mattress 106. Additionally, the cavity 166 is defined by a base portion 170 of the section 118 extending along a portion of a base surface 172 of the boxspring 108. Additionally, the cavity 166 is defined by a vertical portion 174 of the section 118 which links the base portion 170 and top portion 138, and extends along the side surface 132 of the mattress 106 and boxspring 108, when the mattress 106 and boxspring 108 are received within the cavity 166.

As illustrated in the exemplary embodiment of FIG. 4, the frame 110 is positioned on a floor 176 of a room. However, the frame 110 need not be positioned directly on the floor 176 of the room. Additionally, as illustrated in the exemplary embodiment of FIG. 6, the top portion 138 of the side section 118 includes an inner and outer edge 178,180 having a respective inner and outer height 182,184 relative to the floor 176. The inner and outer edge 178,180 are separated by the vertical bumper 136. Additionally, the inner height 182 corresponds with a height at which a child sleeps on the bed 102, while the outer height 184 corresponds with a height after which a child has passed over the vertical bumper 136, prior to falling to the floor 176. As illustrated in the exemplary embodiment of FIG. 6, the outer height 184 is less than the inner height 182. In an exemplary embodiment, the inner height is in the range of 12-18 inches (30.48-45.72 centimeters), and the outer height is in the respective range of 9-11 inches (22.86-27.94 centimeters). Additionally, in an exemplary embodiment, the vertical bumper may be approximately 4 inches (approximately 10.16 centimeters) in height (relative to the top portion 138), approximately 4 inches (approximately 10.16 centimeters) in width, and approximately 48 inches (approximately 121.9 centimeters) in length (along the side section 118).

Figure 7:
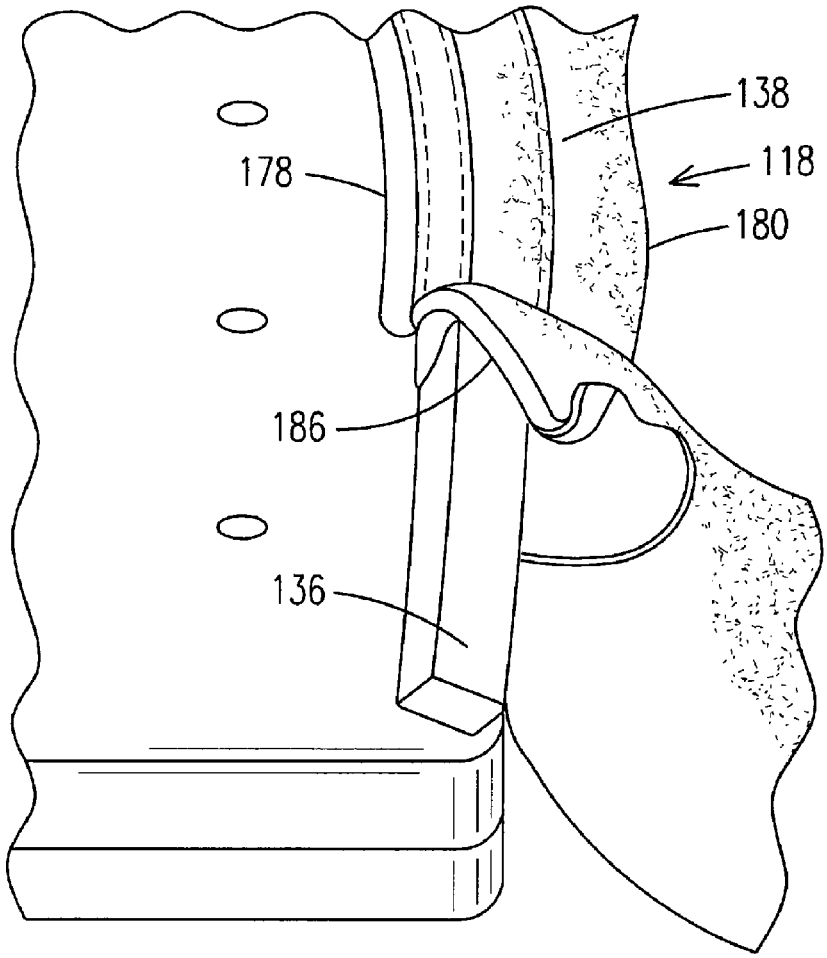
FIG. 7 depicts a partial top perspective view of a removable bumper inserted within a slot of a section of the system illustrated in FIG. 4.

As illustrated in the exemplary embodiment of FIG. 7, a respective slot 186 is formed within the top portion 138 of the side section 118. The respective slot 186 is formed in a direction along the side section 118. Additionally, the vertical bumper 136 is to be removably inserted within the slot 186. Although FIG. 7 illustrates the slot 186 formed within the top portion 138 of the side section 118, an equivalent slot is formed in the top portion of the side section 116, and the vertical bumper 134 is removably inserted within that slot. Although FIG. 7 illustrates that the vertical bumper is removably insertable within the slot, in an exemplary embodiment, the vertical bumper may be directly attached to the top portion 138, using VELCRO® fasteners, a registered trademark, or a zipper, for example, and thus no slot would be needed. In an exemplary embodiment, the respective vertical bumpers 134, 136 are formed from a high-density foam material, and are washable, such that they may be easily washed and replaced upon being removed from their respective slots. As with the removably insertable bumper 136 positioned within the slot 186, a removable insert may be positioned within a slot (not shown) adjacent the rear of the head 146 of the animate object, to provide additional neck support, for example. In an exemplary embodiment, such a slot adjacent the rear of the head 146 may encircle the perimeter of the neck, and the removable insert may be sized such that it provides additional support to the neck and/or head of the animate object, when inserted within the slot, for example.

Figure 8:
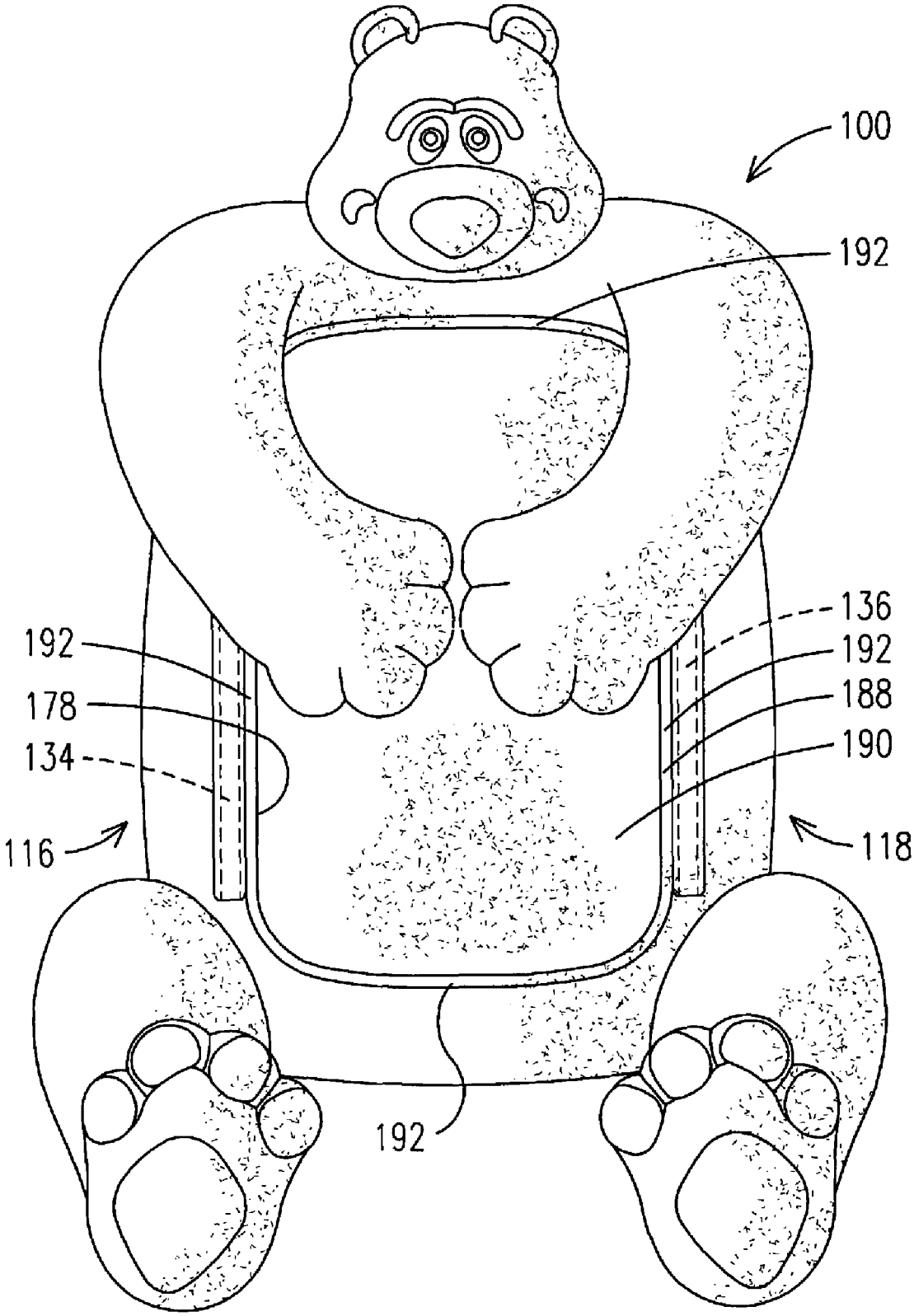
FIG. 8 depicts a top plan view of the system illustrated in FIG. 1, with a blanket covering the mattress.

As illustrated in the exemplary embodiment of FIG. 8, the inner edge 178 of the side sections 116,118 includes an integrated elastic fabric 188 to maintain the respective vertical bumpers 134,136 in an upright orientation relative to the top portion 138 of the side sections 116,118. The integrated elastic fabric 188 may be sewn and/or weaved into the plush material fabric of the inner edge 178 of the side sections 116,118, for example. The elastic fabric 188 maintains an inward compression from the side sections 116,118 on the opposing side surfaces 130,132 of the mattress 106 and the boxspring 108, such that the frame 110 maintains an upright orientation, relative to the mattress 106 and boxspring 108. Additionally, as illustrated in the exemplary embodiment of FIG. 8, the system 100 includes a bed sheet 190 to cover the mattress 106, and a perimeter of the bed sheet 190 includes hook and loop fasteners 192, such as VELCRO® fasteners, a registered trademark, or a zipper, for example. Upon placement of the bed sheet 190 on the mattress 106, the hook-and-loop fasteners 192 of the bed sheet 190 perimeter secure to a plurality of hook-and-loop fasteners 192 positioned along the inner edge 178 of the side sections. Thus, the bed sheet 190 is positioned on the mattress 106, to provide further support in maintaining the side sections 116,118 and frame 110 in an upright orientation, for example.

Figure 10:
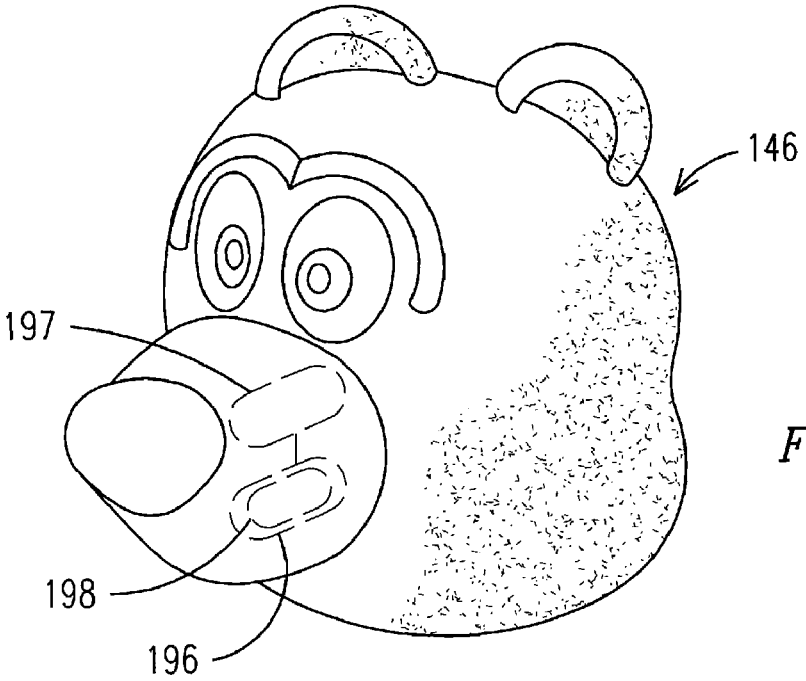
FIG. 10 depicts a partial perspective view of a head portion of the frame illustrated in FIG. 1, with a cavity formed within the head portion to receive an audio output device.

As illustrated in the exemplary embodiment of FIG. 10, a cavity 196 is formed within the head 146 of the top section 114 of the frame 110. The cavity 196 is formed and sized to receive an audio output device 198 to transmit an audio signal capable of being heard by the child in the bed 102. The audio output device 198 is coupled to a power source and an audio input device 197, such that the audio input device 197 detects an audible input, such as a child's voice, and the audio output device 198 initiates transmission of the audio signal, based on the detection of the audible input by the audio input device 197. In an exemplary embodiment, the audio output device may be a speaker, CD player, MP3 player, and/or any audio output device known to one of skill in the art which is capable of outputting an audio signal, based on an input signal. In an exemplary embodiment, the audio input device may be a microphone, or similar device, to detect the child's voice, and may be configured to distinguish whether the child is requesting a particular audio signal, such as a particular audio track/bed-time story, which is stored in a memory connected to the audio output device. The audio output device may be configured to receive a signal from the audio input device, which indicates a desired audio track/bed-time story, and subsequently outputs the desired audio track/bed-time story. Although FIG. 10 illustrates the audio input/output device 197,198 being positioned with the head 146 of the animate object, the audio input output devices 197,198 may be positioned at any location within the animate object.

Figure 11:
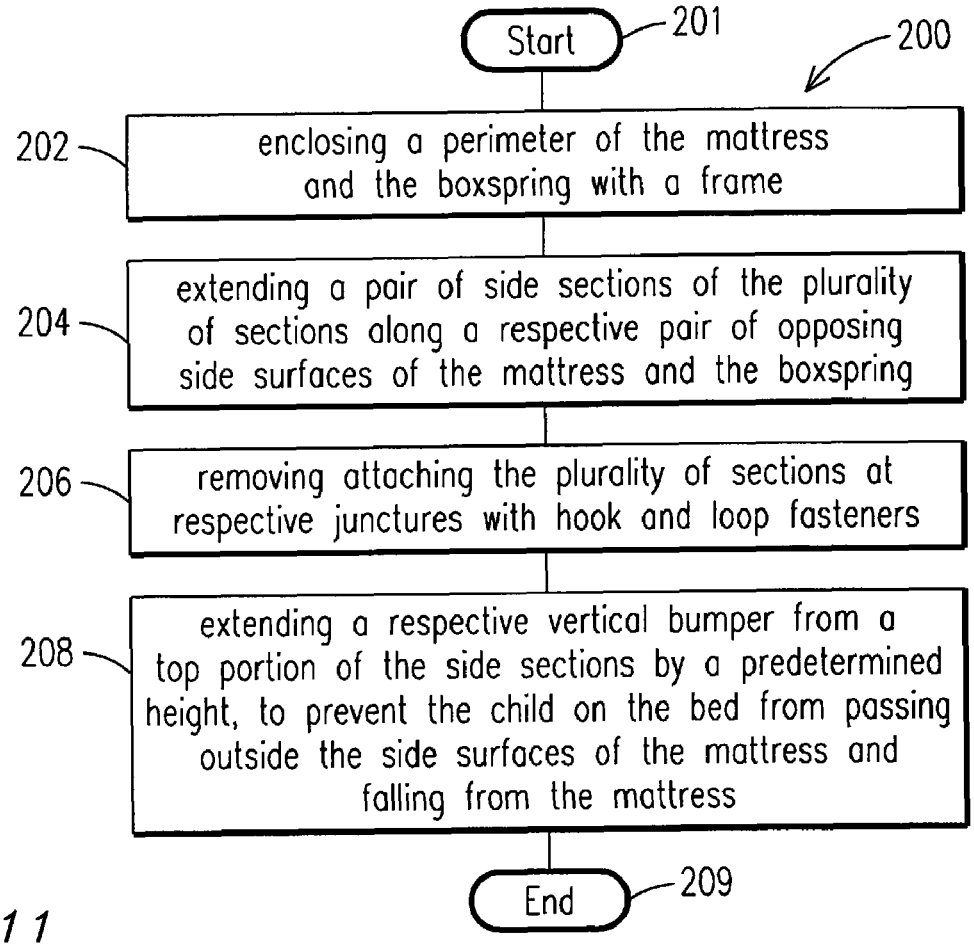
FIG. 11 depicts a flowchart illustrating an exemplary embodiment of a method for enhancing the safety of a sleeping arrangement for a child on a bed in accordance with the present invention.

FIG. 11 illustrates a flowchart depicting an exemplary embodiment of a method 200 for enhancing the safety of a sleeping arrangement for a child on a bed 102. The method 200 begins at 201 by enclosing 202 a perimeter of the mattress 106 and the boxspring 108 with a frame 110. The frame 110 includes a plurality of sections 114,116,118, and has an outer surface 128 formed from a plush material. The enclosing 202 step includes extending 204 a pair of side sections 116,118 of the plurality of sections along a respective pair of opposing side surfaces 130,132 of the mattress 106 and the boxspring 108. The enclosing 202 step also includes removably attaching 206 the plurality of sections 114,116,118 at respective junctures 120,122,124 with hook and loop fasteners 126. The method 200 further includes extending 208 a respective vertical bumper 134,136 from a top portion 138 of the side sections 116,118 by a predetermined height, to prevent the child on the bed 102 from passing outside the side surfaces 130,132 of the mattress 106 and falling from the mattress 106.

While the present invention has been described with reference to various exemplary embodiments, it will be understood by those skilled in the art that various changes, omissions and/or additions may be made and equivalents may be substituted for elements thereof without departing from the spirit and scope of the invention. Therefore, it is intended that the invention not be limited to the particular embodiment disclosed as the best mode contemplated for carrying out this invention, but that the invention will include all embodiments falling within the scope of the appended claims. Moreover, unless specifically stated any use of the terms first, second, etc. do not denote any order or importance, but rather the terms first, second, etc. are used to distinguish one element from another.

What is claimed is:

1. A system for enhancing the safety of a sleeping arrangement for a child on a bed, said bed including a mattress and a boxspring, said system comprising:

a textile or fabric frame configured to enclose a perimeter of the mattress and the boxspring, said frame including a plurality of sections, said plurality of sections being removably attached at respective junctures with flexible textile fasteners;

wherein an outer surface of said frame is formed from a plush material;

and wherein said plurality of sections include a pair of side sections configured to extend along a respective pair of opposing side surfaces of the mattress and the boxspring, said pair of side sections including a respective vertical bumper configured to extend from a top portion of said side sections by a predetermined height, to prevent the child on the bed from passing outside said side surfaces of the mattress and falling from the mattress.

2. The system of claim 1, wherein said frame takes the form of an animate object.

3. The system of claim 1, wherein said plush material is washable; and wherein an interior of said frame is filled with a foam and/or cushion material.

4. The system of claim 1, wherein said flexible textile fasteners comprise hook and loop fasteners or zippers.

5. The system of claim 2, wherein said plurality of sections include:

a top section to form at least one of a head, shoulders, arms of the animate object; and the pair of side sections to form at least one of a side and legs of the animate object;

wherein said top section and side sections are removably attached with said flexible textile fasteners adjacent to an arm-pit juncture of the animate object, and wherein said respective side sections are removably attached with said flexible textile fasteners adjacent to a heel portion of said legs of the animate object.

6. The system of claim 1, wherein said plurality of sections are respectively dimensioned such that a portion of said mattress and boxspring are received within a cavity of the respective sections.

7. The system of claim 6, wherein said cavity is defined by the top portion of said section configured to extend along a portion of a top surface of the mattress, a base portion of said section configured to extend along a portion of a base surface of the boxspring, and a vertical portion configured to link the base portion and top portion and configured to extend along the side surface of the mattress and boxspring, when said mattress and boxspring are received within said cavity.

8. The system of claim 1, wherein said bed is positioned on a floor of a room, and wherein said top portion of the side section includes an inner and outer edge having a respective inner and outer height relative to said floor; said inner and outer edge being separated by said vertical bumper; wherein said inner height corresponds with a child sleeping on the bed, while said outer height corresponds with a child having passed over the vertical bumper, said outer height being less than said inner height.

9. The system of claim 8, wherein said inner height is in the range of 12-18 inches (30.48-45.72 centimeters), and said outer height is in the respective range of 9-11 inches (22.86-27.94 centimeters).

10. The system of claim 1, wherein a respective slot is formed within the top portion of the respective side sections, said respective slot is formed in a direction along the respective side sections; and wherein said respective vertical bumper is to be removably inserted within the respective slot.

11. The system of claim 10, wherein said respective vertical bumper is formed from a high-density foam material, said high-density foam material being washable.

12. The system of claim 8, wherein said inner edge of said side sections includes an integrated elastic fabric configured to maintain said respective vertical bumper in an upright orientation relative to said top portion of said side section.

13. The system of claim 12, wherein said elastic fabric is configured to maintain an inward compression from said side sections on said opposing side surfaces of said mattress and said boxspring such that said frame maintains an upright orientation.

14. The system of claim 12, wherein said system includes a bed sheet configured to cover said mattress, wherein a perimeter of said bed sheet includes a plurality of hook-and-loop fasteners; wherein upon placement of said bed sheet on said mattress, said hook-and-loop fasteners of said bed sheet perimeter are secured to a plurality of hook-and-loop fasteners positioned along the inner edge of said side sections.

15. The system of claim 5, wherein a cavity is formed within said top section to receive an audio output device, said audio output device configured to transmit an audio signal capable of being heard by the child in the bed.

16. The system of claim 15, wherein said audio output device is coupled to a power source and an audio input device, said audio input device being configured to detect an audible input, and said audio output device is configured to initiate transmission of the audio signal based on said detection of the audible input by the audio input device.

17. The system of claim 5, wherein an end of said arms of the animate object includes a slot configured to receive a hand of the child such that the arms of the animate object embrace the child.

18. A system for enhancing the safety of a sleeping arrangement for a child on a bed, said bed including a mattress, said system comprising:

a soft frame configured to surround a perimeter of the mattress, said frame including a plurality of sections, said plurality of sections being removably attached to one another with flexible textile fasteners;

and wherein said plurality of sections include a pair of side sections configured to extend along a respective pair of opposing side surfaces of the mattress, said pair of side sections including a respective vertical bumper configured to extend from a top portion of said side sections by a predetermined height, to prevent the child on the bed from falling from the mattress.

19. A method for enhancing the safety of a sleeping arrangement for a child on a bed, said bed including a mattress and a boxspring, said method comprising:

enclosing a perimeter of the mattress and the boxspring with a frame, said frame including a plurality of sections, and having an outer surface formed from a plush material, said enclosing comprising;

extending a pair of side sections of the plurality of sections along a respective pair of opposing side surfaces of the mattress and the boxspring, removably attaching the plurality of sections at respective junctures with flexible textile fasteners, extending a respective vertical bumper from a top portion of said side sections by a predetermined height, to prevent the child on the bed from passing outside said side surfaces of the mattress and falling from the mattress.

20. The method of claim 19, wherein said enclosing includes receiving a portion of said mattress and boxspring within a cavity of the respective sections, said receiving including:

extending the top portion of said section along a portion of a top surface of the mattress;

extending a base portion of said section along a portion of a base surface of the boxspring; and extending a vertical portion of said section along the side surface of the mattress and the boxspring.

21. The method of claim 19, further comprising:

positioning the bed on a floor of a room;

forming an inner edge and an outer edge within said top portion of the side section, said inner and outer edge being separated by said vertical bumper;

configuring said inner edge such that an inner height between the inner edge and the floor corresponds with a child sleeping on the bed;

configuring said outer edge such that an outer height between the outer edge and the floor corresponds with a child having passed over the vertical bumper, said outer height being less than said inner height.

22. The method of claim 19, further comprising:

forming a respective slot in the top portion of the respective side sections, said respective slot is aligned in a direction along the respective side sections; and removably inserting said vertical bumper within the respective slot.

23. The method of claim 21, further comprising:

integrating an elastic fabric within said top portion of the side section;

maintaining an inward compression from said side sections toward said opposing side surfaces of said mattress and said boxspring, to achieve an upright orientation of said respective vertical bumper and said frame.

* * * * *